United States Patent [19]

Logan et al.

[11] Patent Number: 4,529,196

[45] Date of Patent: Jul. 16, 1985

[54] EXERCISE DEVICE

[76] Inventors: Robert C. Logan, 523 Lincoln Way East; Howard L. Bierley, 4421 Grape Vine Rd., both of Chambersburg, Pa. 17201

[21] Appl. No.: 469,640

[22] Filed: Feb. 25, 1983

[51] Int. Cl.[3] ..... A63B 21/22

[52] U.S. Cl. ..... 272/116

[58] Field of Search ..... 272/132, 129, 130, 116

[56] References Cited

U.S. PATENT DOCUMENTS

| | | | |
|---|---|---|---|
| 3,421,500 | 1/1969 | Jacobson | 272/93 |
| 3,588,101 | 6/1971 | Jungreis | 272/117 |
| 3,866,914 | 2/1975 | Jackson | 272/81 |
| 3,874,659 | 4/1975 | Aharoni | 272/129 |
| 4,235,437 | 11/1980 | Ruis et al. | 272/129 |
| 4,239,092 | 12/1980 | Janson | 188/267 |
| 4,249,725 | 2/1981 | Mattox | 272/117 |
| 4,261,562 | 4/1981 | Flavell | 272/129 |
| 4,337,050 | 6/1982 | Engalitcheff | 272/130 |
| 4,354,676 | 10/1982 | Ariel | 272/130 |

*Primary Examiner*—Richard C. Pinkham
*Assistant Examiner*—Leo P. Picard
*Attorney, Agent, or Firm*—Beall Law Offices

[57] ABSTRACT

An exercise device provides a programmable resistance over a range of body movements designed specifically for the type of body movement, with provisions for changing the program to other types of body movement and for adjusting the range of resistance for the program type to match variations in strength for different individuals. Preferably, the resistance is provided by permanent magnet coupling, and the magnetic flux coupling is changed, to correspondingly change the resistance, by moving the permanent magnets relative to magnetic material by means of a cam to establish a fixed program of resistance versus angular movement and further changed by adjusting the relative position between the permanent magnets and the magnetic material to change the range of resistance to the same program. Provision is made to return the coupling to an initial start position at the termination of the movement.

17 Claims, 5 Drawing Figures

FIG. 3
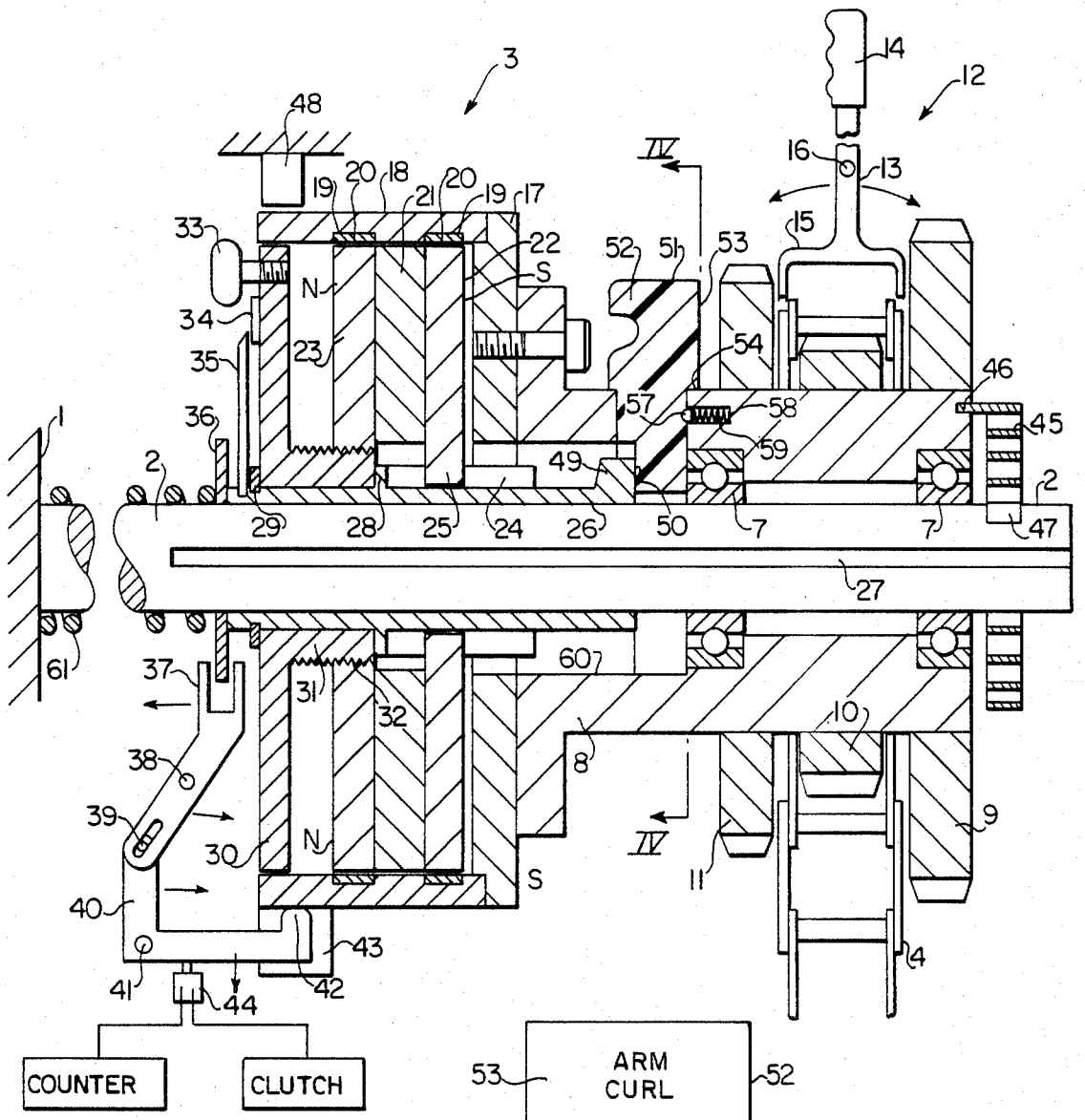
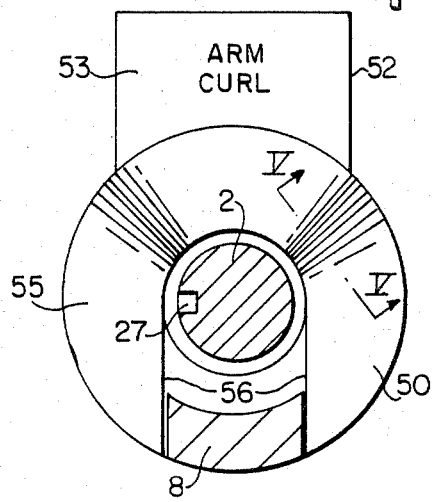
FIG. 4
FIG. 5
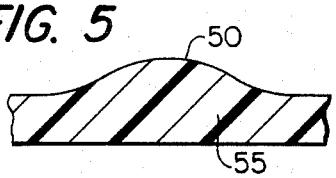

EXERCISE DEVICE

BACKGROUND OF THE INVENTION

Various types of exercise machines are known, and they provide adjustment to vary the resistance of the machine for the needs of the particular user, with it being recognized that some users are stronger than others.

Cost is an important item, because if the cost is too great the machines will not be employed.

When simple weights were used on bars, that progress of the person using the weighted bars for exercise could be measured very accurately, by the total weight applied to the bars for different exercises. However, with the advent of more sophisticated machines, there has developed a considerable problem in accurately determining the progress of a user, because with what appears to be the same set-up, the resistance will vary greatly from day to day due to internal friction and inaccuracies in the apparatus. That is, the repeatability for a desired result is quite poor.

SUMMARY OF THE INVENTION

It is an object of the present invention to provide a highly effective exercising machine that is of low cost relative to its performance, has a high accuracy with respect to repeatability, is reliable and simple to maintain, may be easily adapted to the varying strength of different users, may be programmed to simulate the variable strength requirements in a single exercise movement, and has very little space requirements.

These objects are specifically obtained with the use of a magnetic coupling, or brake, which employs permanent magnets to provide the resistance. A programmable element, particularly employing a selectable cam, provides the desired resistance versus movement curve for the particular exercise being performed, and the programmable element may be easily exchanged for different exercises. The range of resistance provided by the programmable element may be grossly adjusted for matching the strength of particular users.

BRIEF DESCRIPTION OF THE DRAWING

Further objects, advantages and features of the present invention will become more clear from the following description of a preferred embodiment, shown in the accompanying drawing, wherein:

FIG. 3 shows the resistance device of the present invention, on a larger scale than and to be connected to the device of FIG. 2;

FIG. 4 shows the programmable element, and is a cross sectional view taken along line IV—IV of FIG. 3; and FIG. 5 is a cross sectional view taken along line V—V of FIG. 4.

DETAILED DESCRIPTION OF A PREFERRED EMBODIMENT

A well known type of exercise movement is that of the arms in a push-up. Basically, the difficulty of the exercise increases as the body is lowered and the arms become more bent. Many people will "cheat" on such an exercise by only going part-way down, so that they can do many more push-ups than someone else of equal strength who goes all the way down. Also, in this exercise, when the arms are bent but little, due to leverage they have far more strength than when they are bent greatly, and as a result the arms are exercised very little during the first part of a push-up when they are bent but little. The present invention may be used so that the user's arms undergo the same movement as in the conventional push-up, but in contrast, the resistance may be specifically programmed for the most desirable results over the entire movement of the arms. For example, this may be provided in the present apparatus when programmed to produce the resistance versus movement curve of FIG. 1.

Figure 1:
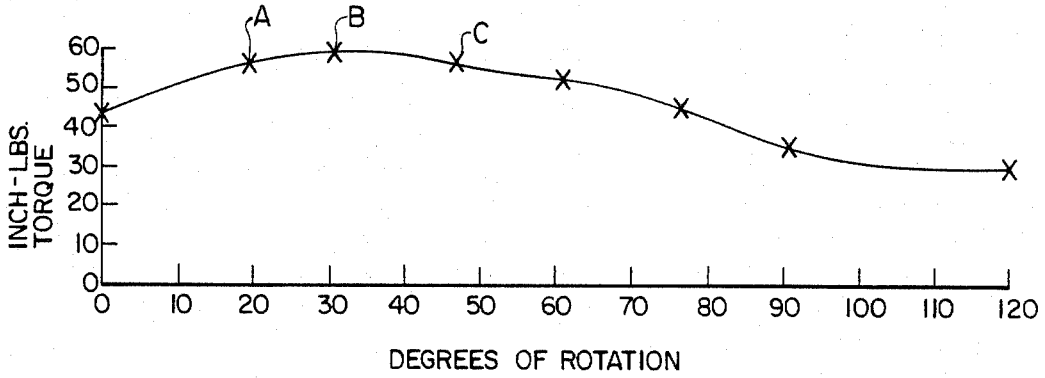
FIG. 1 is a resistance versus exercise movement curve that may be provided by the present invention.

In FIG. 1, the indicated degrees of rotation refer to rotation of the resistance device, to be described in more detail hereinafter, and is directly correlated to the amount of movement undergone by the user's body member that engages the apparatus, which in the example above may be considered as linear movement of the person's hands when simulating a push-up. From the curve, it is seen that the resistance is relatively high when the exercise is started and the person's arms are effectively extending straight out from their body. While the curve shows inch pounds with respect to the torque provided by the resistance device, the mechanical advantages of the apparatus may be selected so that this may be transferred to direct pounds force of the desired amount where the apparatus engages the body. In the specific example of FIG. 1, 43 inch pounds at 0 degrees of rotation, would correspond to the resistance provided at the beginning of the push-up exercise with the arms extending straight out from the body, which for the purpose of the example, may, by the chosen mechanical advantage, translate to 430 pounds where the user engages the apparatus. It is seen that with movement of the arms, the force increases, and then decreases towards the end of the movement, where the arms are close to the body. The entire arm movement of the user may correspond to 120 degrees rotation of the resistance device.

Of course, the curve of FIG. 1 would be different for different exercises. For example, for a swimmer's freestyle, the arm has very little mechanical advantage when fully extended above the swimmer's head, so that it would be desirable to have very little resistance provided by the resistance device, and for the resistance to increase to its maximum about halfway through the stroke and then decrease towards the end of the stroke to simulate the actual resistance provided by the act of swimming.

The body engaging device may take on many different forms, for example, engaging the head, the hands, the feet, the end of a held tennis racket, or the like. Therefore, the body engaging device of FIG. 2 may take on many different forms to cooperate with the resistance provided device of FIG. 3 (shown on a larger scale).

Figure 2:
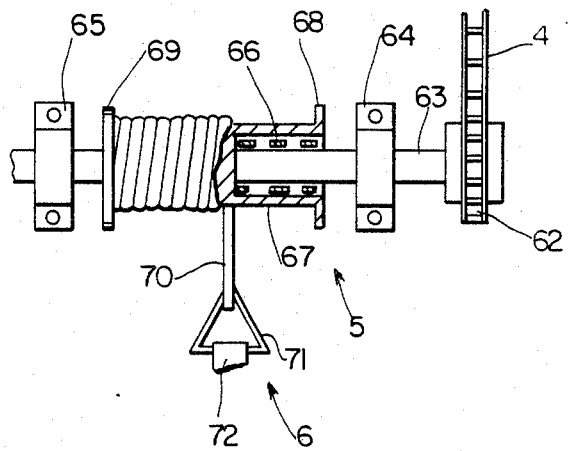
FIG. 2 shows the body-engaging portion of the apparatus of the present invention.

In FIG. 3, a fixed support 1 fixedly mounts a cantilevered shaft 2 for supporting the resistance device 3. A chain 4 drivingly connects the resistance device of FIG. 3 with the body-engaging device of FIG. 2. In FIG. 2, a winding device 5 will wind and unwind a cable under the control of the body-engaging device 6 that is secured to the user's body.

In FIG. 3, bearings 7 freely and rotatable support a hub 8 on the cantilevered shaft 2. A large sprocket 9, a small sprocket 10, and an intermediate sprocket 11 are respectively drivingly and fixedly secured to the hub 8. A shifter 12 is provided to shift the chain 4 for selectively engaging only one of the sprockets 9, 10, 11, to correspondingly change the mechanical advantage between the resistance device of FIG. 3 and the body-engaging device of FIG. 2 for gross adjustments of the force range. The shifting device 12 includes a lever 13, provided with a handle 14, shifting fork 15, and fixed pivot axis 16. The handle 14 is grasped to move the shifting fork 15 about the pivot axis 16 in the directions of the arrows to correspondingly engage sprocket 9 or 11. The shifter 12 is actually located so as to be spaced a considerable distance from the sprockets 9, 10 and 11, for example, midway between the devices of FIGS. 2 and 3, and operates much in the manner of a shifting fork for a multi-speed bicycle.

As seen, a plate 17 is bolted to a flange of the hub 8 and has welded or otherwised fixed to it a cylindrical drum 18. The inside cylindrical surface of the drum 18 has two inwardly opening grooves 19 that are filled with magnetic particles 20. A permanent magnet 21, which may, in fact, be made up of many individual permanent magnets, is fixedly secured to a first magnetic soft plate 22 and a second magnetic soft plate 23, to be sandwiched therebetween as a rigid unit. A plurality of splines 24 interengage with corresponding keyways 25 on the first magnetic soft plate, and the splines 24 are carried on a sleeve 26 that is, in turn, keyed to the shaft 2 for rotation therewith by means of a keyway 27. That is, the sleeve 26 is rotationally secured to the shaft 2 by the keyway and free to move axially relative to the shaft 2. The unit comprising the permanent magnet 21 and plates 22, 23, is splined to the sleeve 26 for rotation with the shaft 2 and for free axial displacement relative to the sleeve 26. The sleeve 26 is provided with a shoulder 28 and a removable retaining ring 29 that together rotatable mount a disc 30 by means of its disc hub 31 onto the sleeve 26 and, thus, onto the shaft 2 for relative rotation with respect to the shaft 2 while preventing axial displacement of the disc 30 relative to the sleeve 26. The external cylindrical surface of the disc hub 31 is provided with a screw thread 32 that is threaded to the correspondingly threaded internal cylindrical surface of the plate 23. Handle 33 is secured to the disc 30 and may be manually grasped to rotate the disc 30, which will cause the plates 22 and 23 with their permanent magnet 21 between them to move axially back and forth depending upon the direction of rotation provided by the handle 33. An arcuate array of numbers, letters, or the like are arranged on the disc 30 about the axis of rotation at 34 to provide an indicia. A pointer 35 is secured to the sleeve 26 and thereby fixed, so that the pointer 35 and indicia 34 will provide an indication of the amount of rotation of the disc 30 and, therefore, the amount of axial displacement of the permanent magnet 21 and thereby the resistance range.

Basically, the elements 26, 25, 23, 22, 21, 20, 19, 18, 17, provide a magnetic coupling, more specifically a magnetic brake, that may be of the type disclosed in U.S. Pat. No. 4,239,092, issued Dec. 16, 1980, to Janson, the disclosure of which is incorporated herein in its entirety. Other types of magnetic couplings or magnetic brakes may be employed, for example, the well known magnetic fluid type of coupling wherein the resistance varies proportionally to the magnetic flux, which is, in turn, varied by varying the current supplied to electromagnets. However, the preferred embodiment employing permanent magnets has an advantage that no current source is needed.

The greatest amount of resistance to relative rotation between the hub 8 and the shaft 2 is provided by the positioning of the permanent magnet 21 as shown in FIG. 3. With movement of the permanent magnet 21 axially to the left in FIG. 3, the resistance provided is correspondingly reduced. Therefore, the handle 33 may be used to move the permanent magnet 21 to the left to adjust the resistance device for usage by a person having less strength than the previous user. For a greater degree of adjustment, the shifter 12 may be used to shift the chain 4 to a larger sprocket and reduce the mechanical advantage that the user has over the resistance device. That is, the shifter 12 is used for gross resistance range adjustments while the handle 33 is used for smaller adjustments. For this purpose, the indicia 34 may have three scales corresponding to the three different sprockets, respectively.

If it is desired to provide resistance to movement in only one direction for the user, for example, in a swimmer's stroke, provision may be made to remove the resistance upon reverse rotation of the resistance device. For this purpose, a release ring 36 is rigidly secured to the sleeve 26, for example, by welding, for axial movement therewith relative to the shaft 2. A release lever 37 is provided with a fork as shown to engage the ring 36, so that pivoting of the lever 37 about its fixed pivot axis 38 as shown by the arrows will move the ring 36 and thus the sleeve 26 axially to the left to correspondingly move the permanent magnet 21 to the left. Sufficient movement is provided so that the permanent magnet 21 may be moved a distance sufficient to eliminate the resistance provided by the magnetic coupling or reduce it to a negligible extent. The lever 37 is rotated by means of a lost motion connection 39 to a transfer lever 40 that pivots about a pivot axis 41 and has on it a cam follower 42. A cam 43 is secured to the outer periphery of the hub 18 and may take the form of a simple wedge extending over only 10 degrees of the hub 18. With reference to FIG. 1, when the resistance device of FIG. 3 is rotated through its 120 degrees of rotation, the cam 43 will just begin to engage the cam follower 42 as shown in FIG. 3. The next 10 degrees of rotation of the hub 8 will force the wedge cam 43 under the cam follower 42 to pivot the lever 40 and lever 37 as shown and effectively release the magnetic coupling as previously described so that the hub 8 will then provide no resistance to rotation. Simultaneously with the rotation of the lever 40, a limit switch 44 may be activated to operate a counter that will count and visually indicate the number of exercise repetitions. Also, the switch 44 may actuate a clutch, which clutch is to be described in detail later.

For return of the resistance device to its zero degrees of rotation point as indicated in FIG. 1 for the start of a new exercise movement, a helical spring 45 is provided. The spring 45 has a spring attachment 46 securing one of its ends to the hub 8, and has a spring attachment 47 securing its opposite end to the shaft 2. During the exercise movement from 0 to 120 degrees, in the example, the spring 45 is progressively wound. The spring 45 is a very light spring and does not materially affect the resistance provided by the resistance device when compared to the far greater resistance provided by the magnetic coupling, and its only purpose is that of a return spring. When the cam 43 engages the follower 42 to provide for shifting of the ring 36 and thereby the magnet 21 to the left to remove the resistance provided by the magnetic coupling, the spring 45 will quickly rotate the hub in a direction that is the reverse of the exercise direction to return the hub to its zero degree position. If desired, a dash pot may be provided to slow the movement of the sleeve 26 from its left shifted position provided by the cam 43 to its right operative position shown in FIG. 3, to provide sufficient time for the spring 45 to return the hub to its zero degree starting point before significant resistance is provided by the magnetic coupling. Such a dash pot is not shown, but may take on any conventional form or merely be provided by sufficient friction between the sleeve 26 and the shaft 2. While the resistance device is shown in the position of 120 degrees rotation, with respect to the example of FIG. 1, with the spring 45 fully wound, with operation of the cam 43 as described above, the hub will rotate in the reverse direction until the cam 43 strikes a fixed abutment 48 to determine the zero degree point or starting point. The follower 42 and fixed abutment 48 have been shown 180 degrees apart merely for purposes of illustration and may be any number of degrees apart, including the 120 degrees apart illustrated in FIG. 1, but less than 360 degrees.

If the resistance device were to be used in a continuously rotating mode, for example, on a treadmill, the spring 45, levers 37 and 40, and fixed abutment 48 would not be needed and, therefore, would be removed.

Whether operating continuously as on a treadmill or over a limited arc as in FIG. 1, the resistance provided by the resistance device varies proportionally to angular movement. When simulating a push-up, the angular movement by the mechanical advantage of sprockets and chains would be translated to a linear movement of only two or three feet, but with operation as a treadmill, it would be desirable to have the 360 degrees rotation of the hub be translated to a linear movement on the treadmill of perhaps 1/10th of a mile, with varying resistance simulating hills.

While the shifter 12 was described above for providing a gross difference in resistance, the shifter 12 may be also used to provide for a change in the ratio between degrees of rotation for the resistance device and linear movement for the body engaging device of FIG. 2, for example, the desired linear movement for the body engaging device of FIG. 2 would be small for a short person doing a push-up for 120 degrees of rotation of the resistance device, when compared to a tall person having longer arms.

To provide for the varying resistance of the magnetic coupling throughout its rotation, there is provided a cam follower 49 on the right-hand end of the sleeve 26, a cam 50 carried by an adjustment plate 51 having a handle 52, and a spring 61 to urge the sleeve 26 to the right for engaging the cam and cam follower. The plate 51, as shown in FIG. 4, is provided with indicia 53 that identifies its usage, which in this example, would be for simulating the resistance desired for an arm curl. The plate 51 is provided with one or more shoulders 54, which may be arcuate, but which engage the outer periphery of the hub 8 to limit the insertion of the disc 51 into a correspondingly shaped slot in the hub 8. The plate 51 is of a generally C-shape to fit into a correspondingly shaped slot cut into the hub 8. The inner portion of the plate 51 is in the form of an interrupted disc, with the interrupt being shown at the bottom in FIG. 4 to provide for a connecting portion of the hub 8. The plate 51 is held in the position shown in FIG. 3 by means of a detent recess in the disc 55, and a detent 57 in a bore 58 of hub 8, which includes a spring 59. The detent mechanism 57, 58, 59 is of a conventional structure, per se, wherein the ball is captive within the hub 8, but will resiliently extend outwardly to engage within the detent recess of the plate 51 to securely hold the plate 51 within the slot of the hub throughout rotation of the hub. The hub 8 is provided with an enlarged bore 60, which freely carries therein the cam follower 49. It is seen that with rotation of the hub 8, the disc 51 and its cam surface 50 will correspondingly rotate relative to the cam follower 49 of the sleeve 26. As shown in FIG. 5, the cam 50 has a wavey surface, which will correspondingly reciprocate the sleeve 26 during rotation of the hub to correspondingly vary the magnetic coupling and thus vary the resistance provided by the resistance device. When the resistance device is used for continuous rotation with respect to a treadmill, for example, an abutment would be provided between the shaft 2 and sleeve 26 to prevent cam follower 49 from entering the discontinuous portion of the cam 50 to provide for continuous relative rotation. (Such an abutment is not shown, but could merely be a ring welded to the shaft 2 to engage the right-hand end of the sleeve 26 in FIG. 3 interiorly of the inner radial surface of the plate 51.)

The body-engaging device of FIG. 2 employs a sprocket 62 for engaging with the endless chain 4. The sprocket 62 is on a split shaft 63 coupled by clutch 64 and in bearing 65. A conventional wrap coiled spring one-way clutch 66 is provided between the shaft 63 and the interior cylindrical surface of a cable drum 67. The cable drum 67 is provided with flanges 68 and 69, so that a cable 70 may be wrapped thereon in a helical manner and unwrapped by pulling on a handle 71 secured to the cable 70 directly by engaging the body with the handle 71 or indirectly by engaging the body with a strap 72 that is secured to the handle 71.

During operation for an arm curl, with the desired resistance characteristics for an arm curl to be as shown in FIG. 1, the following sequence of events will occur. If the user has very long arms, the shifter 12 may be used to shift the chain 4 to the sprocket 9. If the user is not as strong as the previous user, the handle 33 may be used to rotate the indicia 34 relative to the pointer 35 to a position indicated for the scale of sprocket 9 where the resistance is less. The counter may be set at 0. The user checks the proper program, that is, reads the indicia 53 to make sure that the arm curl cam plate has been inserted, in case the previous user was using some other cam plate for some other type of exercise. Now the user begins the exercise by repeatedly pulling on the cable 70 for the arm curl. As the cable 70 is pulled, the one-way coil spring clutch 66 wraps down on the shaft 63 to drive the shaft 63, chain 4, sprocket 9 and hub 8 with resistance being provided by the magnetic coupling 18-23, through 120 degrees of rotation of the coupling in accordance with the program provided by the plate 51 and illustrated in FIG. 1. At the end of each curl movement, the cable is pulled a small additional amount to engage the cam 43 with the follower 42 for shifting the ring 36 and the sleeve 26 and permanent magnet 21 to the left to disengage the magnetic coupling, so that the coil spring 45 may quickly return the hub 8 to its zero degree or starting position. At the same time of the engagement of the cam 43 with the cam follower 42, the switch 44 is activated to add one to the counter for keeping track of the number of curls, and the switch 44 also disengages the clutch 64 that will permit return movement of the hub 8 regardless of further activity by the user. At this point, the user returns his arm to the beginning position without any resistance, because upon reverse rotation of the cable drum 67, the one-way coil spring clutch 66 will disengage the cable drum 67 from the shaft 63, and the cable will be wound on the drum 67 as the drum is rotated by means of a spring (not shown). The cable drum spring may be a spring identical to the spring 45, but, of course, having its opposite ends connected to the cable drum 67 and shaft 63 and can conveniently be carried within the interior of the left-hand portion of the cable drum 67 as shown in FIG. 2.

If a sufficiently long delay is provided by the abovementioned dash pot (not shown), the clutch 64 may be eliminated. Also, the counter could be a mechanical counter driven mechanically by the movement of the lever 40, or the lever 37, or directly by the cam 43. Thus, all electrical controls or power requirements could be eliminated. The need for clutch 64 could also be eliminated by using a spring urged latch to hold ring 36 in its far left position, where moved by cam 43, until abutment 48 is engaged by cam 43 to release the latch.

While a preferred embodiment has been specifically shown for purposes of illustration as well as for the desirability of its details, there are broader aspects of the present invention, for example, as discussed with respect to the alternatives, variations, and other embodiments, all as defined by the spirit and scope of the following claims.

What is claimed is:

1. An exercise machine for exercising a movable body part of a user, wherein a resistance device is connected through a drive to a body-engaging device to be connected to the movable part as it moves through an exercise movement, said exercise machine comprising:

said resistance device including a generally rotationally fixed support member;

a rotatable member mounted to said support member for relative rotation therebetween;

magnetic coupling means providing a torque resistant slip coupling between said rotatable member and said support member;

means connecting said rotatable member is to said drive;

purely mechanical programmable means operatively controlling said magnetic coupling means to establish a fixed program torque to angular rotation curve producing a fixed torque resistance between said rotatable member and said support member for each angular displacement between said rotatable member and said support member over a fixed range;

means for selectively changing said fixed program to a different fixed program;

separate means adjusting said exercise machine to change all resistance values of said program by the same amount to produce a new range;

said magnetic coupling means including permanent magnetics having north and south poles secured to one of said members, magnetic material secured to the other of said members, and means establishing flux path between said magnetic material and said north pole and separate flux path between said south pole and said magnetic material during rotation to provide torque; and said magnetic material extending in an annular path having a center of curvature at the axis of rotation of said rotatable member and said north and south poles being spaced from each other.

2. The exercise machine of claim 1, wherein said adjusting means includes indicia means to indicate the adjusted range of torque.

3. The exercise machine of claim 1, wherein said programmable means includes indicia means to indicate the selected program.

4. The exercise machine of claim 3, wherein said adjusting means includes indicia means to indicate the adjusted range of torque.

5. The exercise machine of claim 1, wherein said adjusting means move said rotatable member relative to said support member generally perpendicular to said flux paths, so as to displace the north and south poles from the magnetic material in a direction other than about said axis to increase and decrease the torque required for relative rotational movement between said rotatable member and said support member, respectively.

6. The exercise machine of claim 5, further including means for establishing a fixed range of rotation between said rotatable member and said support member, having a starting relative position and a termination relative position at the range extremes;

means to sense the termination position of the exercise movement, and in accordance with such sensing substantially reduce the torque between said rotatable member and said support member so as to maintain the torque below a low fixed value; and power means for exerting a restoring torque greater than said low torque value, substantially less than normal programmed torques and operable to return said rotatable member to a starting position at the extreme of said range of movement.

7. The exercise machine of claim 1, wherein said purely mechanical programmable means includes an annular cam surface on the first of said rotatable member and said support member and a follower surface on the second of said rotatable member and said support member;

said permanent magnets being fixedly secured to one of said annular cam surface and said follower and said magnetic material being affixed to the other of said annular cam surface and said follower;

means biasing said cam and follower towards each other so that rotational movement of said rotatable member relative to said support member will produce a cam controlled reciprocating movement relatively between said magnetic material and said permanent magnets to respectively increase or decrease the torque therebetween.

8. The exercise machine of claim 7, wherein said reciprocating movement is in the axial direction.

9. The exercise machine of claim 8, wherein said adjustment means includes means for selectively adjusting the fixed connection between one of said magnetic material and said permanent magnets and its respective one of said annular cam surface and follower.

10. The exercise machine of claim 1, further including means for establishing a fixed range of rotation between said rotatable member and said support member, having a starting relative position and a termination relative position at the range extremes;

means to sense the termination position of the exercise movement, and in accordance with such sensing substantially reduce the torque between said rotatable member and said support member so as to maintain the torque below a low fixed value;

and power means for exerting a restoring torque greater than said low torque value, substantially less than normal programmed torques and operable to return said rotatable member to a starting position at the extreme of said range of movement.

11. The exercise machine of claim 10, wherein said programmable means includes an annular cam surface on the first of said rotatable member and said support member, and a follower surface on the second of said rotatable member and said support member;

said permanent magnets being fixedly secured to one of said annular cam surface and said follower and said magnetic material being affixed to the other of said annular cam surface and said follower; and means biasing said cam and follower towards each other so that rotational movement of said rotatable member relative to said support member will produce a cam-controlled reciprocating movement relatively between said magnetic material and said permanent magnets to respectively increase or decrease the torque therebetween.

12. The exercise machine of claim 11, wherein said reciprocating movement is in the axial direction.

13. The exercise machine of claim 11, wherein said adjustment means includes means for selectively adjusting the fixed connection between one of said magnetic material and said permanent magnets and its respective one of said annular cam surface and follower.

14. The exercise machine of claim 1, wherein said programmable means includes an annular cam surface on the first of said rotatable member and said support member, and a follower surface on the second of said rotatable member and said support member;

said permanent magnets being fixedly secured to one of said annular cam surface and said follower and said magnetic material being affixed to the other of said annular cam surface and said follower;

means biasing said cam and follower towards each other so that rotational movement of said rotatable member relative to said support member will produce a cam-controlled reciprocating movement relatively between said magnetic material and said permanent magnets to respectively increase or decrease the torque therebetween.

15. The exercise machine of claim 14, wherein said adjustment means includes means for selectively adjusting the fixed connection between one of said magnetic material and said permanent magnets and its respective one of said annular cam surface and follower.

16. The exercise machine of claim 14, wherein said reciprocating movement is in the axial direction.

17. The exercise machine of claim 16, wherein said adjustment means includes means for selectively adjusting the fixed connection between one of said magnetic material and said permanent magnets and its respective one of said annular cam surface and follower.

* * * * *